US006105728A

United States Patent [19]

Combs, Jr.

[11] Patent Number: 6,105,728

[45] Date of Patent: Aug. 22, 2000

[54] HANDICAPPED DUCK BLIND ELEVATOR SYSTEM

[76] Inventor: Bert L. Combs, Jr., 290 Clowes Rd., Covington, Tenn. 38109

[21] Appl. No.: 09/188,791

[22] Filed: Nov. 7, 1998

[51] Int. Cl.[7] ..... B66B 5/12

[52] U.S. Cl. ..... 187/372; 187/254; 187/361; 187/410; 182/145

[58] Field of Search ..... 187/251, 254, 187/266, 311, 312, 348, 350, 351, 352, 361, 372, 410; 182/141, 142, 145, 146; 254/387

[56] References Cited

U.S. PATENT DOCUMENTS

| | | | |
|---|---|---|---|
| 630,473 | 8/1899 | Tracy | 187/351 |
| 1,163,239 | 12/1915 | Iron | 187/372 |
| 1,274,746 | 8/1918 | Murphy | 187/372 |
| 1,381,555 | 6/1921 | Hodson | 187/372 |
| 1,980,230 | 11/1934 | See | 187/350 |
| 2,963,178 | 12/1960 | Walker | 187/239 |
| 3,166,154 | 1/1965 | Titzel | 182/145 |
| 3,441,107 | 4/1969 | Thorne et al. | 187/350 |
| 3,908,801 | 9/1975 | Pohlman | 187/372 |
| 4,664,230 | 5/1987 | Olsen | 187/372 |

FOREIGN PATENT DOCUMENTS

| | | | |
|---|---|---|---|
| 4-72287 | 3/1992 | Japan | 187/239 |

*Primary Examiner*—Robert P. Olszewski
*Assistant Examiner*—Thuy V. Tran
*Attorney, Agent, or Firm*—Michael S. Neustel

[57] ABSTRACT

A handicapped duck blind elevator system for elevating/lowering handicapped individuals to and from a conventional duck blind structure. The inventive device includes a support frame that is mounted adjacent a conventional duck blind, a lift cage frame slidably retained within the support frame, a winch attached to the support frame for elevating/lowering the lift cage frame, and a boat ramp positioned within a conventional duck boat. A first ramp is provided within the lift cage frame for loading/unloading an individual within a wheelchair from the boat ramp into the floor of the lift cage frame. A second ramp is provided within the lift cage frame for unloading/loading an individual within a wheelchair from the conventional duck blind.

20 Claims, 6 Drawing Sheets

HANDICAPPED DUCK BLIND ELEVATOR SYSTEM

BACKGROUND OF THE INVENTION

1. Field of the Invention

The present invention relates generally to elevator devices and more specifically it relates to a handicapped duck blind elevator system for elevating/lowering handicapped individuals to and from a conventional duck blind structure.

Conventional duck blinds are constructed to elevate a platform that supports duck hunters during high waters. Prior to the present invention, there has been no feasible means for elevating an individual within a wheelchair onto a platform of an elevated duck blind. Hence, there is a need for an invention that will elevate/lower a handicapped individual to and from a conventional elevated duck blind so that they may enjoy duck hunting to its fullest extent.

2. Description of the Prior Art

Elevator devices have been in use for years. Typically, a conventional elevator system will have one doorway for loading passengers. Conventional elevator devices are mainly suitable for enclosed building structures and not for outdoor structures such as duck blinds. In addition, conventional elevator devices do not provide a means for loading and unloading a handicapped individual in various levels of water.

Examples of elevator devices include U.S. Pat. No. 5,595,265 to Lebrocquy; U.S. Pat. No. 4,926,973 to Smith; U.S. Pat. No. 5,628,274 to Biedenweg et al; U.S. Pat. No. 5,102,179 to Royer; U.S. Pat. No. 5,806,632 to Budd et al; U.S. Pat. No. 5,803,694 to Steele; U.S. Pat. No. 4,719,716 to Chrisley; U.S. Pat. No. 4,529,063 to Kishi; U.S. Pat. No. 4,252,491 to Hock; U.S. Pat. No. 5,327,993 to Stark which are all illustrative of such prior art.

Lebrocquy (U.S. Pat. No. 5,595,265) discloses a portable vertical lift that acts as a conventional deer stand for a handicapped individual. Lebrocquy is attached vertically to a standing tree for support.

Smith (U.S. Pat. No. 4,926,973) discloses a mobile wheelchair lift and brakes therefore comprised of a frame that supports a movable wheelchair platform for up and down movement.

Biedenweg et al (U.S. Pat. No. 5,628,274) discloses a boat ingress/egress system and ramp allowing ingress/egress to and from a fixed structure.

While these devices may be suitable for the particular purpose to which they address, they are not as suitable for elevating/lowering handicapped individuals to and from a conventional duck blind structure.

In these respects, the handicapped duck blind elevator system according to the present invention substantially departs from the conventional concepts and designs of the prior art, and in so doing provides an apparatus primarily developed for the purpose of elevating/lowering handicapped individuals to and from a conventional duck blind structure.

SUMMARY OF THE INVENTION

In view of the foregoing disadvantages inherent in the known types of elevator devices now present in the prior art, the present invention provides a new handicapped duck blind elevator system construction wherein the same can be utilized for elevating/lowering handicapped individuals to and from a conventional duck blind structure.

The general purpose of the present invention, which will be described subsequently in greater detail, is to provide a new handicapped duck blind elevator system that has many of the advantages of the elevator devices mentioned heretofore and many novel features that result in a new handicapped duck blind elevator system which is not anticipated, rendered obvious, suggested, or even implied by any of the prior art elevator devices, either alone or in any combination thereof.

To attain this, the present invention generally comprises a support frame that is mounted adjacent a conventional duck blind, a lift cage frame slidably retained within the support frame, a winch attached to the support frame for elevating/lowering the lift cage frame, and a boat ramp positioned within a conventional duck boat. A first ramp is provided within the lift cage frame for loading/unloading an individual within a wheelchair from the boat ramp into the floor of the lift cage frame. A second ramp is provided within the lift cage frame for unloading/loading an individual within a wheelchair from the conventional duck blind.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practices and carried out in various ways. Also, it is to be understood that the phraseology and terminology employed herein are for the purpose of the description and should not be regarded as limiting.

A primary object of the present invention is to provide a handicapped duck blind elevator system that will overcome the shortcomings of the prior art devices.

Another object is to provide a handicapped duck blind elevator system that loads and unloads individuals within a wheelchair to and from a conventional elevated duck blind.

An additional object is to provide a handicapped duck blind elevator system that is capable of unloading a handicapped person at various heights.

A further object is to provide a handicapped duck blind elevator system that is capable of loading a handicapped person at various water levels.

Another object is to provide a handicapped duck blind elevator system that is self-supporting.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
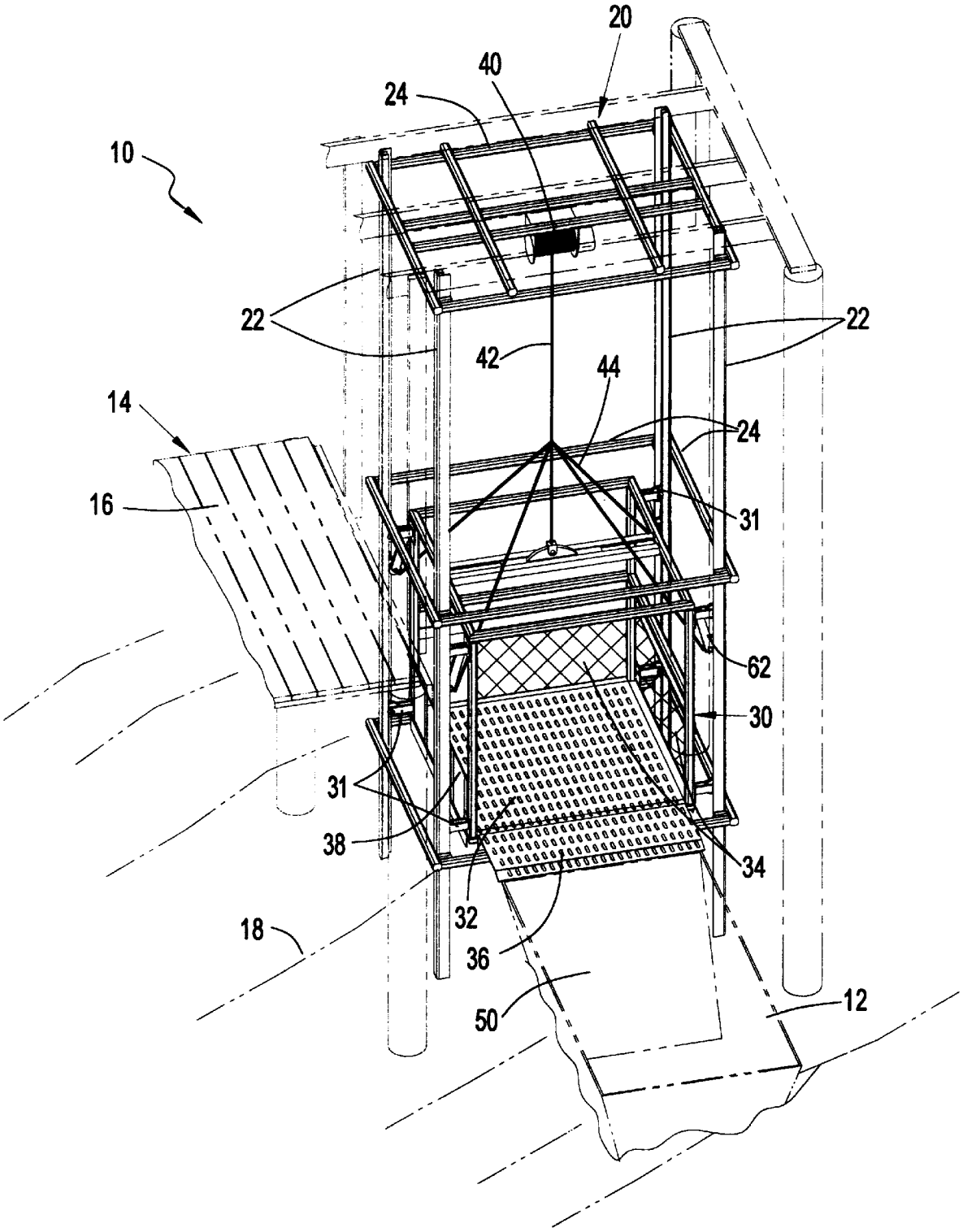
FIG. 1 is an upper perspective view of the present invention with the lift cage lowered near the water level thereby allowing the boat ramp to mate with the first ramp.

Turning now descriptively to the drawings, in which similar reference characters denote similar elements throughout the several view, FIGS. 1 through 6 illustrate a handicapped duck blind elevator system 10, which comprises a support frame 20 that is mounted adjacent a conventional duck blind 14, a lift cage frame 30 slidably retained within the support frame 20, a winch 40 attached to the support frame 20 for elevating/lowering the lift cage frame 30, and a boat ramp 50 positioned within a conventional duck boat 12. A first ramp 36 is provided within the lift cage frame 30 for loading/unloading an individual within a wheelchair from the boat ramp 50 into the floor 32 of the lift cage frame 30. A second ramp 38 is provided within the lift cage frame 30 for unloading/loading an individual within a wheelchair from the conventional duck blind 14.

Figure 6:
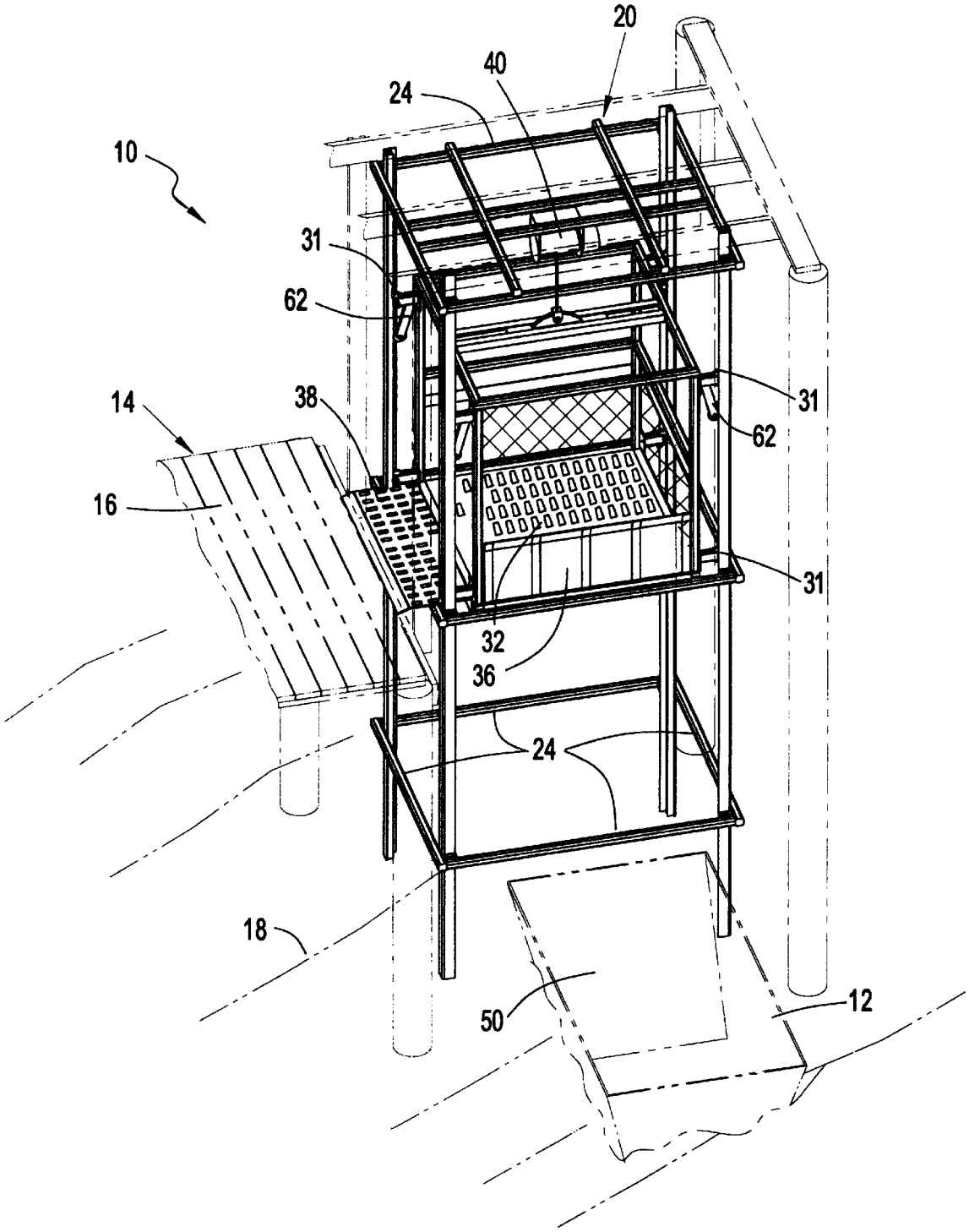
FIG. 6 is an upper perspective view of the present invention with the lift cage raised above the platform of the conventional duck blind thereby allowing loading/unloading of an individual in a wheelchair from the second ramp.

As best shown in FIGS. 1 and 6 of the drawings, the support frame 20 is secured adjacent the conventional duck blind 14 by a conventional securing means such as concrete or other means. The support frame 20 has four comer members 22 aligned vertically with respect to the conventional duck blind 14. A plurality of cross members 24 are attached between the comer members 22 for providing support to the corner members 22. The comer members 22 are preferably constructed of angle iron as shown in FIGS. 1 and 6, however it can be appreciated by one skilled in the art that various other types and shapes of material may be utilized to construct the comer members 22. The support frame 20 may be connected to the duck blind 14 for additional support by a connecting member.

Figure 2:
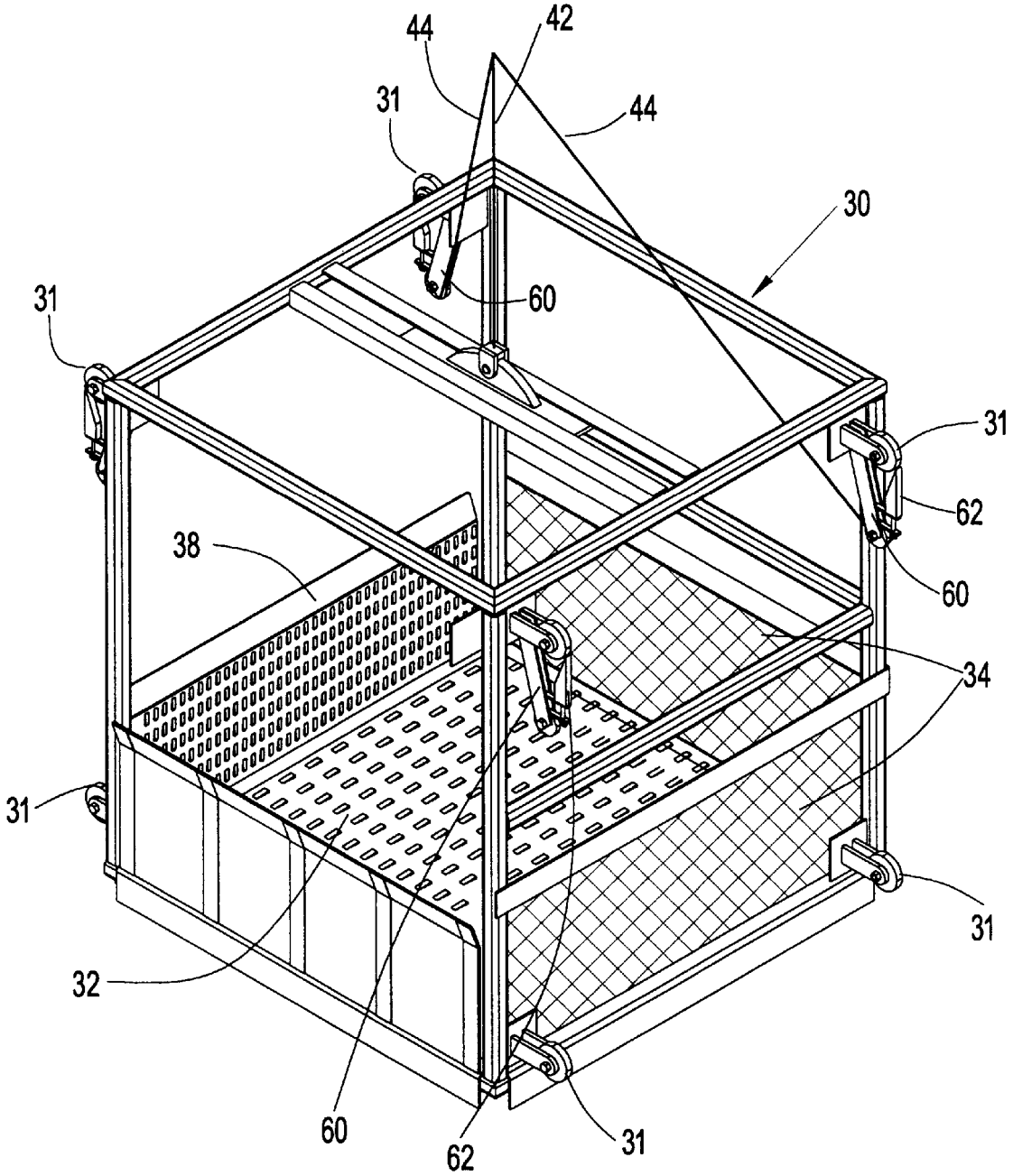
FIG. 2 is an upper perspective view of the lift cage frame.
Figure 3:
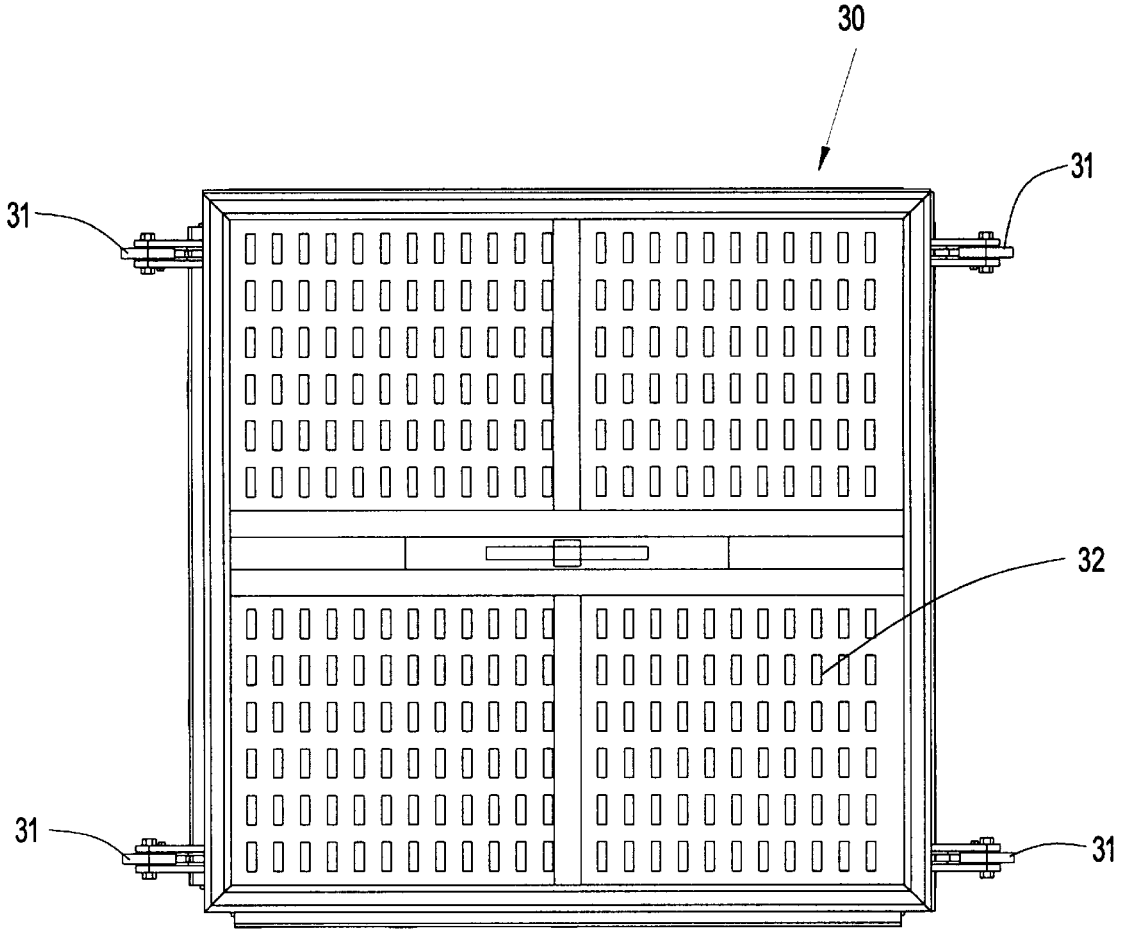
FIG. 3 is a top view of the lift cage frame.
Figure 4:
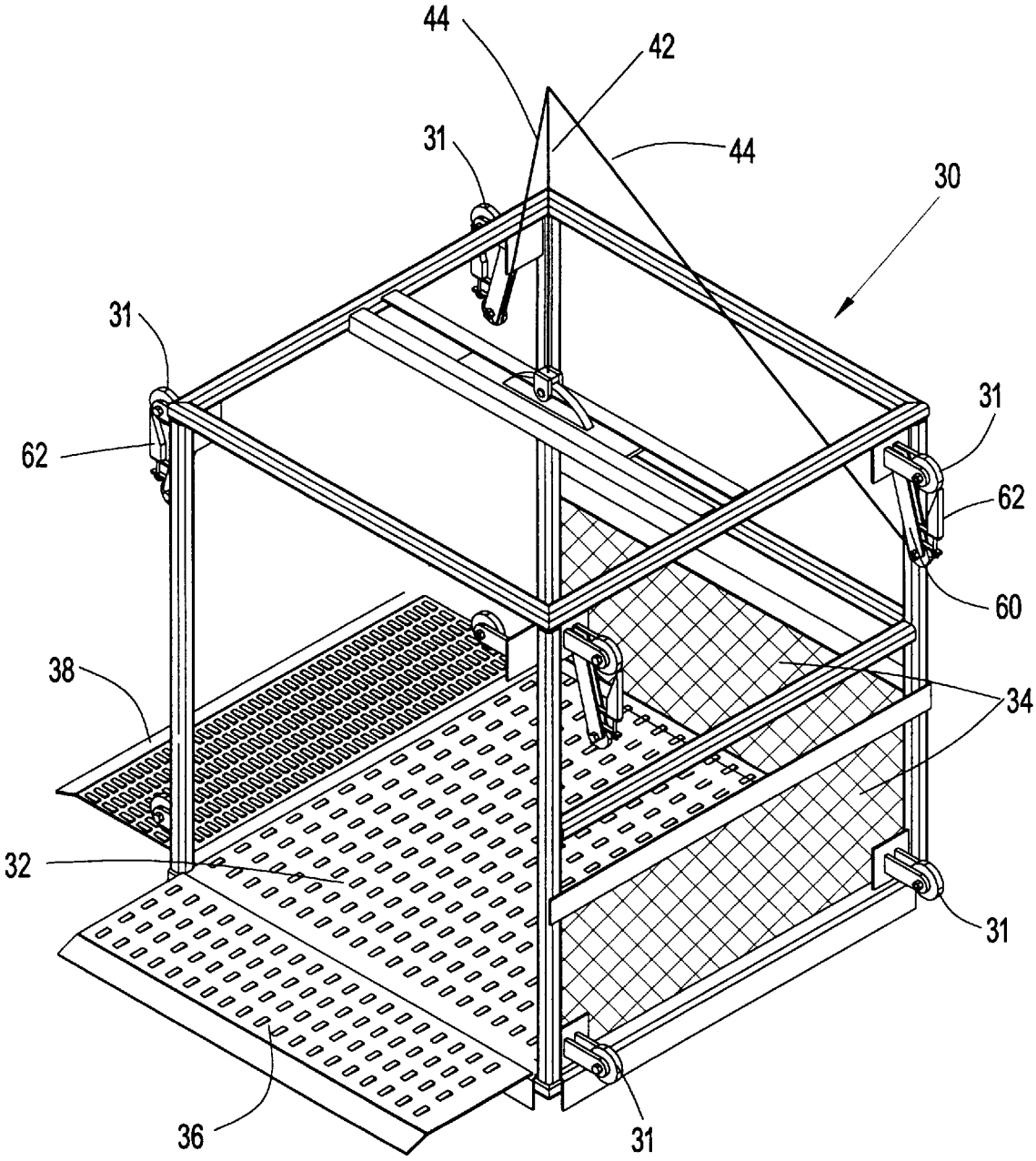
FIG. 4 is an upper perspective view of the lift cage frame with the first and second ramps descended.

As shown in FIGS. 2 and 4 of the drawings, the lift cage frame 30 is substantially rectangular in shape. The lift cage frame 30 includes a floor 32 and a pair of walls 34 preferably adjacent one another. A plurality of wheels 31 are rotatably attached about the comer portions of the lift cage frame 30 and are in engagement with the corner members 22 of the support frame 20 for allowing elevating/lowering of the lift cage frame 30 with respect to the support frame 20 during use. As shown in FIGS. 1 and 6, a conventional winch 40 or other lifting device is connected to a length of support cable 42 that is connected to an upper portion of the lift cage frame 30 for elevating/lowering the lift cage frame 30 with respect to the support frame 20. A control mechanism is utilized to control the operation of the winch 40 which may be comprised of a radio mechanism or a directly connected electrical device.

A first ramp 36 is pivotally attached to the floor 32 of the lift cage frame 30 as shown in FIG. 4 of the drawings. The first ramp 36 may be connected in the upright position to retain the individual within a wheelchair during operation. The first ramp 36 is positionable adjacent a boat ramp 50 secured within a conventional duck boat 12 for loading/unloading an individual within a wheelchair as shown in FIG. 1 of the drawings regardless of the current water level 18.

A second ramp 38 is pivotally attached to the floor 32 of the lift cage frame 30 as shown in FIG. 4 of the drawings. The second ramp 38 may be connected in the upright position to retain the individual within a wheelchair during operation of the lift cage frame 30. The second ramp 38 is positionable adjacent a platform 16 of the conventional duck blind 14 for unloading/loading an individual within a wheelchair to the duck blind 14 as shown in FIG. 6 of the drawings.

Figure 5:
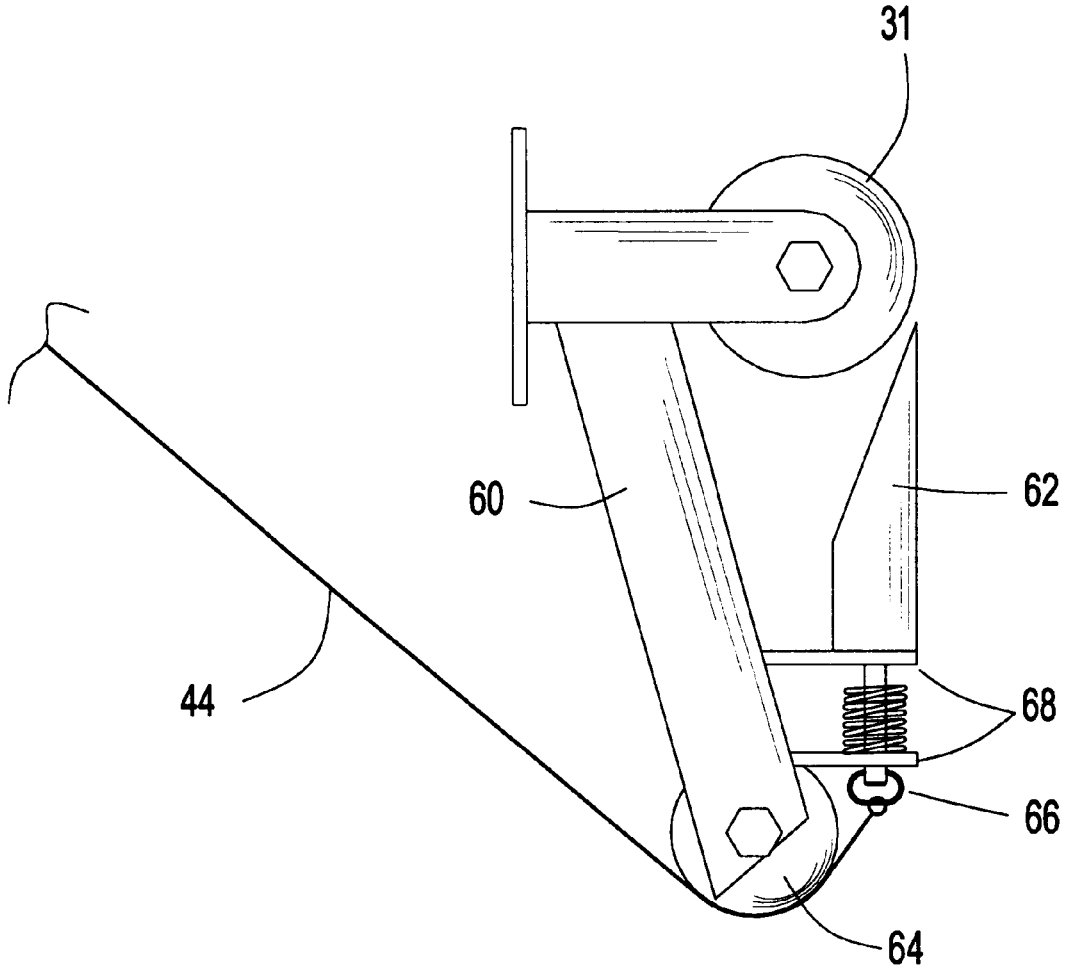
FIG. 5 is a magnified side view of the safety mechanism attached adjacent a wheel.

As best shown in FIG. 5 of the drawings, at least one arm 60 is attached to the lift cage frame 30 adjacent one of the wheels 31. A pulley 64 is rotatably attached to a distal end of the arm 60 as shown in FIG. 5 of the drawings. A pair of brackets 68 are attached to the arm 60 that slidably support a pin 66 within. A wedge 62 is attached to an end of the pin 66 for stopping the wheel 31 in case the support cable 42 should break. A compression spring is positioned within the brackets 68 and about the pin 66 that forces the pin 66 and the wedge 62 toward the wheel 31 during operation. A safety cable 44 is attached to a lower portion of the support cable 42 as shown in FIGS. 1, 2 and 4 of the drawings. The safety cable 44 extends about the pulley 64 as shown in Figure and then is attached to the end of the pin 66 opposite of the wedge 62. When the support cable 42 is properly tensioned during normal operation, the safety cable 44 is also tensioned preventing the wedge 62 from engaging the wheel 31. However, if the support cable 42 should become severed, the tension is dramatically reduced in the safety cable 44 thereby allowing the compression spring to force the wedge 62 between the wheel 31 and the comer member thereby preventing the lift cage frame 30 from free falling.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A handicapped duck blind elevator system for elevating/lowering disabled individuals within a wheelchair to and from a conventional elevated duck blind, comprising:

a support frame having a lower end and an upper end, said lower end is securable to a ground surface adjacent said duck blind;

a lift cage frame having a floor, wherein said lift cage frame is slidably retained within said support frame;

an elevating means attached to said upper end of said support frame and connected to said lift cage frame for selectively elevating and lowering said lift cage frame;

a boat ramp positionable within a conventional boat for loading/unloading an individual in a wheelchair onto said lift cage frame;

wherein said lift cage frame includes a first ramp for matingly engaging said boat ramp during loading and unloading of said individual in said wheelchair;

wherein said lift cage frame includes a second ramp for matingly engaging a platform of said duck blind during loading and unloading of said individual in said wheelchair;

a safety means for preventing said lift cage frame from free falling if said elevating means should malfunction; and wherein said lift cage frame includes a plurality of wheels mounted to corner portions of said lift cage frame for slidably engaging said support frame.

2. The handicapped duck blind elevator system of claim 1, wherein said support frame comprises:

four comer members that slidably receive said plurality of wheels of said lift cage frame; and a plurality of cross members connected between said four comer members forming a substantially rectangular shape.

3. The handicapped duck blind elevator system of claim 2, wherein said corner members are comprised of angle iron.

4. The handicapped duck blind elevator system of claim 1, wherein said elevating means comprises a winch secured to said lift cage frame by a length of support cable.

5. The handicapped duck blind elevator system of claim 1, wherein said safety means comprises:

a plurality of safety cables attached to said length of support cable;

a plurality of arms attached to said lift cage frame adjacent said plurality of wheels;

a plurality of pulleys attached to a distal end of said plurality of arms that rotatably receive said plurality of safety cables;

a pair of brackets attached to each of said plurality of arms that slidably support a pin, wherein said plurality of safety cables are attached to each said pin;

a plurality of wedges attached to an end of said pin opposite of said safety cable; and a compression spring positioned within said pair of brackets and connected about said pin that forces said wedge toward said wheel.

6. The handicapped duck blind elevator system of claim 1, wherein said lift cage includes a pair of walls in opposition to said first ramp and said second ramp.

7. The handicapped duck blind elevator system of claim 1, wherein said first ramp and said second ramp serve as walls during movement of said lift cage frame.

8. A handicapped duck blind elevator system for elevating/lowering disabled individuals within a wheelchair to and from a conventional elevated duck blind, comprising:

a support frame having a lower end and an upper end, said lower end is securable to a ground surface adjacent said duck blind;

a lift cage frame having a floor, wherein said lift cage frame is slidably retained within said support frame;

an elevating means attached to said upper end of said support frame and connected to said lift cage frame for selectively elevating and lowering said lift cage frame;

a safety means for preventing said lift cage frame from free falling if said elevating means should malfunction;

a boat ramp positionable within a conventional boat for loading/unloading an individual in a wheelchair onto said lift cage frame;

wherein said lift cage frame includes a first ramp for matingly engaging said boat ramp during loading and unloading of said individual in said wheelchair;

wherein said lift cage frame includes a second ramp for matingly engaging a platform of said duck blind during loading and unloading of said individual in said wheelchair; and wherein said lift cage frame includes a plurality of wheels mounted to comer portions of said lift cage frame for slidably engaging said support frame.

9. The handicapped duck blind elevator system of claim 8, wherein said support frame comprises:

four corner members that slidably receive said plurality of wheels of said lift cage frame; and a plurality of cross members connected between said four corner members forming a substantially rectangular shape.

10. The handicapped duck blind elevator system of claim 9, wherein said corner members are comprised of angle iron.

11. The handicapped duck blind elevator system of claim 8, wherein said elevating means comprises a winch secured to said lift cage frame by a length of support cable.

12. The handicapped duck blind elevator system of claim 8, wherein said safety means comprises:

a plurality of safety cables attached to said length of support cable;

a plurality of arms attached to said lift cage frame adjacent said plurality of wheels;

a plurality of pulleys attached to a distal end of said plurality of arms that rotatably receive said plurality of safety cables;

a pair of brackets attached to each of said plurality of arms that slidably support a pin, wherein said plurality of safety cables are attached to each said pin;

a plurality of wedges attached to an end of said pin opposite of said safety cable; and a compression spring positioned within said pair of brackets and connected about said pin that forces said wedge toward said wheel.

13. The handicapped duck blind elevator system of claim 8, wherein said first ramp and said second ramp serve as walls during movement of said lift cage frame.

14. A handicapped duck blind elevator system for elevating/lowering disabled individuals within a wheelchair to and from a conventional elevated duck blind, comprising:

a support frame having a lower end and an upper end, said lower end is securable to a ground surface adjacent said duck blind;

a lift cage frame having a floor, wherein said lift cage frame is slidably retained within said support frame;

wherein said lift cage frame includes a plurality of wheels mounted to corner portions of said lift cage frame for slidably engaging said support frame;

an elevating means attached to said upper end of said support frame and connected to said lift cage frame for selectively elevating and lowering said lift cage frame; and a boat ramp positionable within a conventional boat for loading/unloading an individual in a wheelchair onto said lift cage frame.

15. The handicapped duck blind elevator system of claim 14, wherein said lift cage frame includes a first ramp for matingly engaging said boat ramp during loading and unloading of said individual in said wheelchair.

16. The handicapped duck blind elevator system of claim 14, wherein said lift cage frame includes a second ramp for matingly engaging a platform of said duck blind during loading and unloading of said individual in said wheelchair.

17. The handicapped duck blind elevator system of claim 14, including a safety means for preventing said lift cage frame from free falling if said elevating means should malfunction.

18. The handicapped duck blind elevator system of claim 14, wherein said support frame comprises:

four corner members that slidably receive said plurality of wheels of said lift cage frame; and a plurality of cross members connected between said four corner members forming a substantially rectangular shape.

19. The handicapped duck blind elevator system of claim 14, wherein said elevating means comprises a winch secured to said lift cage frame by a length of support cable.

20. The handicapped duck blind elevator system of claim 14, wherein said safety means comprises:

a plurality of safety cables attached to said length of support cable;

a plurality of arms attached to said lift cage frame adjacent said plurality of wheels;

a plurality of pulleys attached to a distal end of said plurality of arms that rotatably receive said plurality of safety cables;

a pair of brackets attached to each of said plurality of arms that slidably support a pin, wherein said plurality of safety cables are attached to each said pin;

a plurality of wedges attached to an end of said pin opposite of said safety cable; and a compression spring positioned within said pair of brackets and connected about said pin that forces said wedge toward said wheel.

* * * * *